US011998815B2

(12) United States Patent
Foortse

(10) Patent No.: US 11,998,815 B2
(45) Date of Patent: Jun. 4, 2024

(54) BAT FOR PLAYING BALL GAMES

(71) Applicant: LIMPET SPORTS MANAGEMENT B.V., Diemen (NL)

(72) Inventor: Paul Foortse, Diemen (NL)

(73) Assignee: Limpet Sports Management B.V., Diemen (NL)

( * ) Notice: Subject to any disclaimer, the term of this patent is extended or adjusted under 35 U.S.C. 154(b) by 521 days.

(21) Appl. No.: 17/371,255

(22) Filed: Jul. 9, 2021

(65) Prior Publication Data

US 2021/0331050 A1 Oct. 28, 2021

Related U.S. Application Data

(63) Continuation of application No. PCT/IB2020/050174, filed on Jan. 10, 2020.

(30) Foreign Application Priority Data

Jan. 10, 2019 (ZA) ..... 2019/00164

(51) Int. Cl.

| | |
|---|---|
| ***A63B 59/48*** | (2015.01) |
| ***A63B 60/00*** | (2015.01) |
| ***A63B 60/54*** | (2015.01) |
| *A63B 102/08* | (2015.01) |

(52) U.S. Cl.

CPC ..... *A63B 59/48* (2015.10); *A63B 60/006* (2020.08); *A63B 60/54* (2015.10); *A63B 2102/08* (2015.10)

(58) Field of Classification Search

CPC ... A63B 59/40–42; A63B 59/48; A63B 59/80; A63B 60/006; A63B 60/54

See application file for complete search history.

(56) References Cited

U.S. PATENT DOCUMENTS

| | | | |
|---|---|---|---|
| 3,934,876 | A | 1/1976 | Haddad |
| 2017/0282030 | A1 | 10/2017 | Foortse |

FOREIGN PATENT DOCUMENTS

| | | | |
|---|---|---|---|
| EP | 0042764 | A1 | 12/1981 |
| EP | 0882476 | A1 | 12/1998 |
| FR | 2934960 | A3 | 2/2010 |

OTHER PUBLICATIONS

International Search Report and Written Opinion of the International Searching Authority for International Application No. PCT/IB2020/050174 dated Apr. 7, 2020.

*Primary Examiner* — Laura Davison

(74) *Attorney, Agent, or Firm* — Heslin Rothenberg Farley & Mesiti PC

(57) ABSTRACT

The plastics bat for playing ball games comprises a handle and a ball-striking head for striking resilient balls. The ball-striking head comprises a rigid outer ring frame integrally formed with the handle, a first discrete lattice structure comprising a semi-rigid single planar lattice element and an identical second discrete lattice structure comprising a semi rigid single planar lattice element. The lattice structures are securely connected to opposite sides of the frame so as to define ball-striking faces, respectively. The lattice structures define an unobstructed internal space between them. The ball-striking head has a lightweight monocoque construction wherein the lattice structures and the frame form a load-carrying outer skin surrounding the hollow internal space.

8 Claims, 9 Drawing Sheets

BAT FOR PLAYING BALL GAMES

CROSS REFERENCE TO RELATED APPLICATIONS

This application claims priority benefit from International Application No. PCT/IB2020/050174 filed on Jan. 10, 2020, which claims priority from South African Application No. 2019/00164 filed on Jan. 10, 2019, each of which are incorporated herein by reference in their entireties.

FIELD OF INVENTION

This invention relates to a bat having an unstressed perforated striking head, for use in playing ball games such as paddle tennis or padel tennis games in playing areas smaller than traditional tennis courts as land becomes evermore scarce and expensive in modern cities.

BACKGROUND OF THE INVENTION

Plastics bats having unstressed perforated ball-striking heads, are known. Such bats are considered a cheaper and more robust alternative to conventional strung racquets or solid faced bats. The present invention is not concerned with bats having heads comprising a single solid panel which may or may not be partially perforated such as solid wooden bats, nor is it concerned with bats having stressed striking surfaces such as strung squash or tennis racquets.

It is also not concerned with padel bats having ball-striking surfaces made from thin glass fibre reinforced membranes having a thickness of about 1 mm, which are stretched across outer surfaces of frames of such bats. Such padel bats are typically filled with plastic foam material and perforated but do not have significant surface ribbing to impart spin to a ball.

An advantage of the use of rigid-faced bats is the reduced level of the trampoline or spring like effect of strung racquets upon impact with a ball which generates more speed off the face of the racquet causing the ball to fly further and faster necessitating the use of a larger playing area. The rise in popularity of relatively new bat and ball games using rigid-faced bats, such as Paddleball, Paddle tennis, Pickleball and Padel on smaller courts is evidence of a swing to smaller courts at the expense of the game of tennis played on conventional larger size courts. Many such bats are heavier and shorter in length than tennis racquets to reduce the bat stroke and ball speed for the smaller courts they are used on.

An important commercial advantage of plastics bats is that they are simple and quick to produce, for example, in an injection moulding process and considerably cheaper than strung tennis racquets or bats made from solid wood.

One of the problems with molded plastics bats has been the fact that many such bats have not been able to reproduce the sweet and solid impact feel experienced with solid wooden bats, tennis racquets or paddle tennis bats which exhibit excellent impact feel.

Bats having unstressed perforated ball-striking heads need to be appropriately weighted for the balls they are to be used with and offer also low air resistance. Such bats should be of a weight which is easy and practical for players to use and wield for any particular type of game.

For a good ball-striking feel, such bats need to be relatively rigid and offer minimal uncomfortable vibrations upon impact with a ball. The rigidity of the ball-striking head is derived from its thickness, the stiffness of its material and its structural design but it is an important design consideration that this is not achieved at the expense of increased mass of the bat or decreased striking head area. Thicker ball-striking heads tend to dampen and reduce impact vibration. It is therefore advantageous for the ball-striking head of a bat to have an adequate thickness which reduces vibration upon impact with a ball and renders the head sufficiently rigid, without making the bat excessively heavy.

It is an object of the present invention to provide an appropriately weighted bat having a perforated ball-striking head which provides a solid low vibration impact feel combined with low air resistance and an acceptable striking head area for striking balls.

SUMMARY OF THE INVENTION

According to the invention there is provided a plastics bat including a handle and a ball-striking head for striking resilient balls, the ball-striking head having a monocoque construction and including:

- a first discrete unstressed plastics lattice defining a first ball-striking surface of the bat; a second discrete unstressed plastics lattice defining a second ball-striking surface of the bat; and at least one peripheral support structure,
- the lattice structures being connected to opposite sides of the peripheral support structure at outer peripheral regions of the lattice structures in a spaced apart arrangement wherein an internal space is defined between the lattice structures absent of any load-bearing internal support structures.

Each of the first and second lattices may have a unitary monolithic structure.

In a first embodiment of the invention, each of the first and second lattice structures may comprise a number of spaced intersecting laths arranged in an open grid pattern wherein openings are defined between the intersecting laths.

In a second embodiment of the invention, each of the first and second lattice structures may comprise a distributed network of alternating webs and unobstructed openings.

Each of the first and second lattice structures may be in the form of a single lattice comprising a single planar lattice element.

Each of the first and second lattice structures may be in the form of a double lattice comprising a pair of spaced planar lattice elements supported by internal struts The peripheral support structure of the ball-striking head of the bat may comprise an outer ring frame to which the lattice structures are connected.

The lattice structures may be fixedly connected to the outer ring frame along peripheral edge regions of the lattice structures.

The lattice structures and the outer frame may form a continuous load-carrying outer skin surrounding the unobstructed internal space.

The ball-striking head of the bat has a monocoque construction wherein the lattice structures together with the outer ring frame, forms an outer skin surrounding the hollow internal space. The ball-striking head of the bat forms a true monocoque system wherein the internal space defined between the lattice structures is characterised by the absence of any load-carrying support structures. As such, the outer skin comprising the lattice structures and the outer frame, carries the compressive forces and loads applied to the ball-striking head when a ball is struck by the ball-striking surfaces of the lattice structures.

According to a second aspect of the invention, there is provided a bat and ball kit comprising the plastics bat as defined and described hereinabove; and a resilient ball having a diameter of between 40 mm and 90 mm and a weight of between 7.5 g and 75 g.

BRIEF DESCRIPTION OF THE DRAWINGS

The accompanying drawings, which are incorporated in and constitute a part of the specification, illustrate embodiments of the invention and together with the detailed description herein, serve to explain the principles of the invention. The drawings are only for purposes of illustrating preferred embodiments and are not to be construed as limiting the invention. It is emphasized that, in accordance with the standard practice in the industry, various features are not drawn to scale. In fact, the dimensions of the various features may be arbitrarily increased or reduced for clarity of discussion. The foregoing and other objects, features and advantages of the invention are apparent from the following detailed description taken in conjunction with the accompanying drawings in which.

DETAILED DESCRIPTION OF THE INVENTION

In this specification, the term "lattice" is intended to refer to lattice or grid structures which are thin in relation to their lengths and breadths and which are perforated by a series of openings of a variety of shapes.

In this specification, the term "ball" must be interpreted sufficiently broadly to include a reference to a ball, sphere, shuttlecock or the like, which is configured to be struck by a bat in a "bat and ball" game.

Figure 1A:
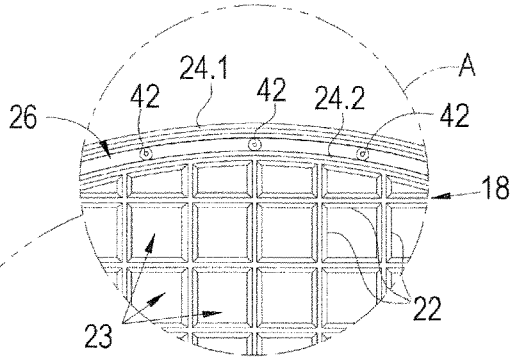
FIG. 1A shows enlarged detail A of FIG. 1, in accordance with an aspect of the present disclosure.
Figure 1:
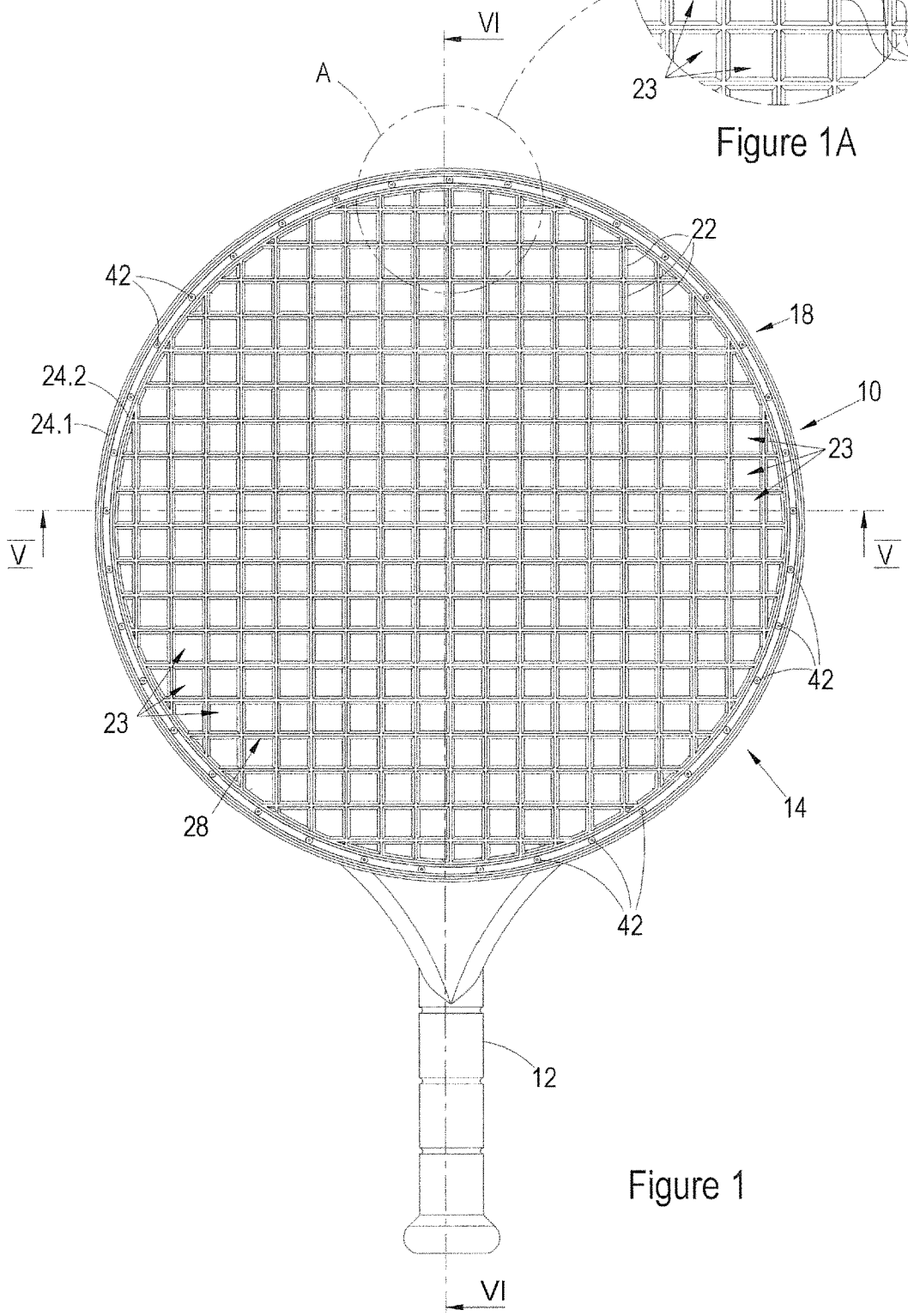
FIG. 1 shows a plan view of a first embodiment of a bat for playing ball games, in accordance with an aspect of the present disclosure.
Figure 2:
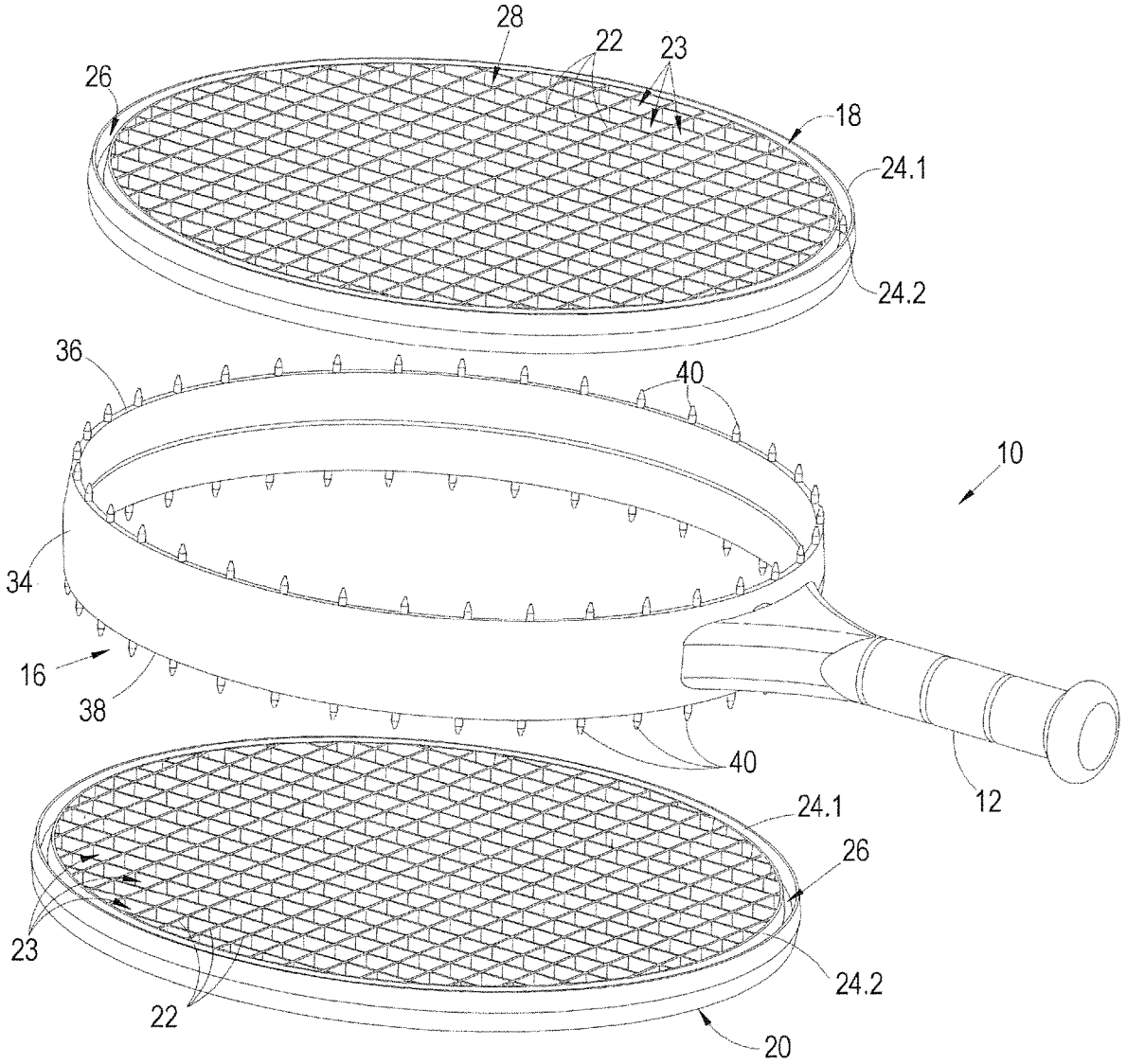
FIG. 2 shows an exploded three-dimensional view of the bat of FIG. 1, in accordance with an aspect of the present disclosure.
Figure 3:
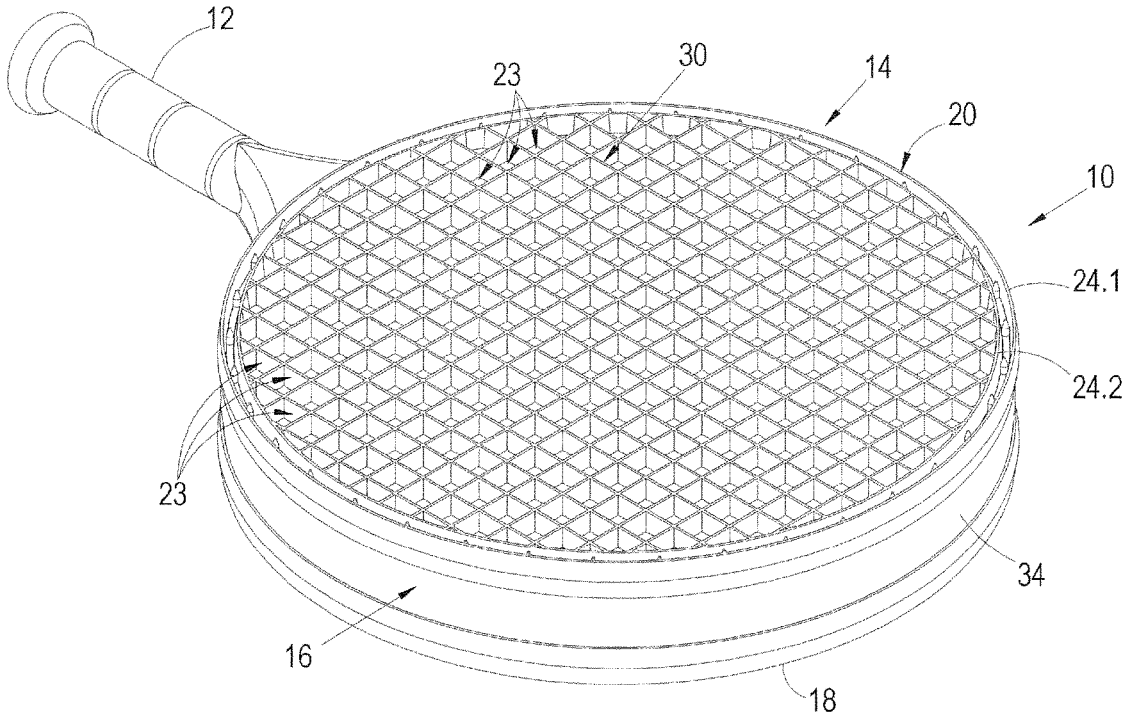
FIG. 3 shows a three-dimensional view of the bat of FIG. 1, as seen from one side of the bat, in accordance with an aspect of the present disclosure.
Figure 4:
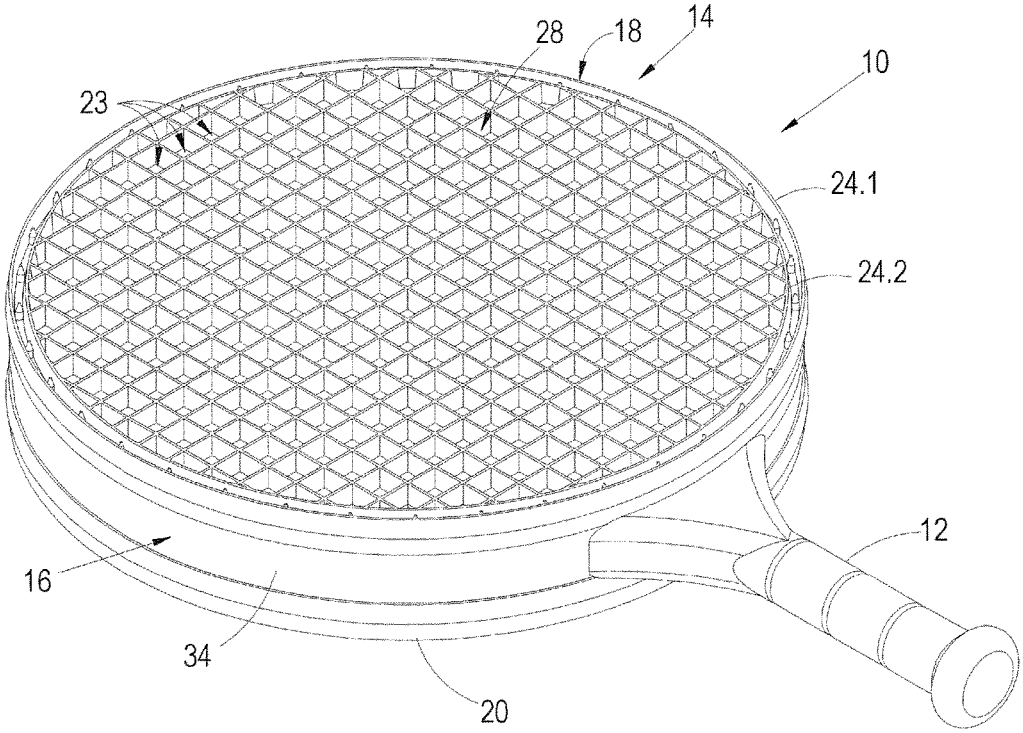
FIG. 4 shows a three-dimensional view of the bat of FIG. 1, as seen from an opposite side of the bat, in accordance with an aspect of the present disclosure.
Figure 5:
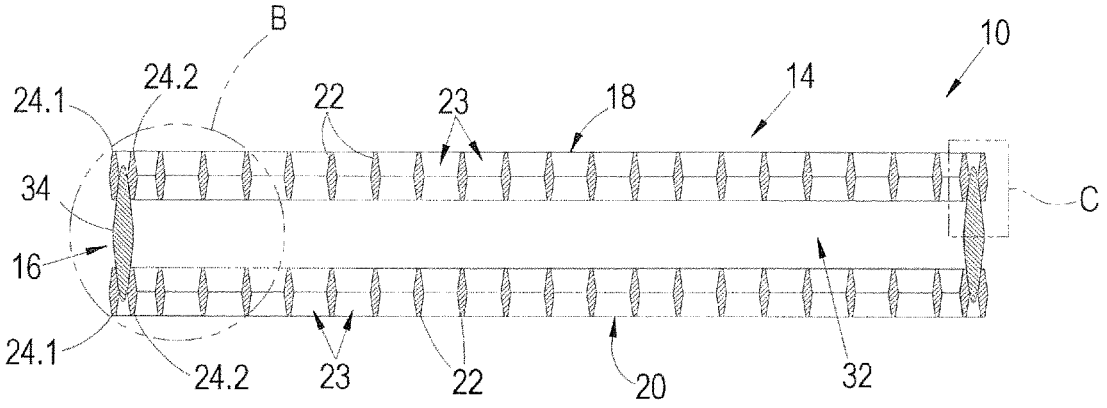
FIG. 5 shows a sectional end view of the bat of FIG. 1, sectioned along section line V-V of FIG. 1, in accordance with an aspect of the present disclosure.
Figure 5A:
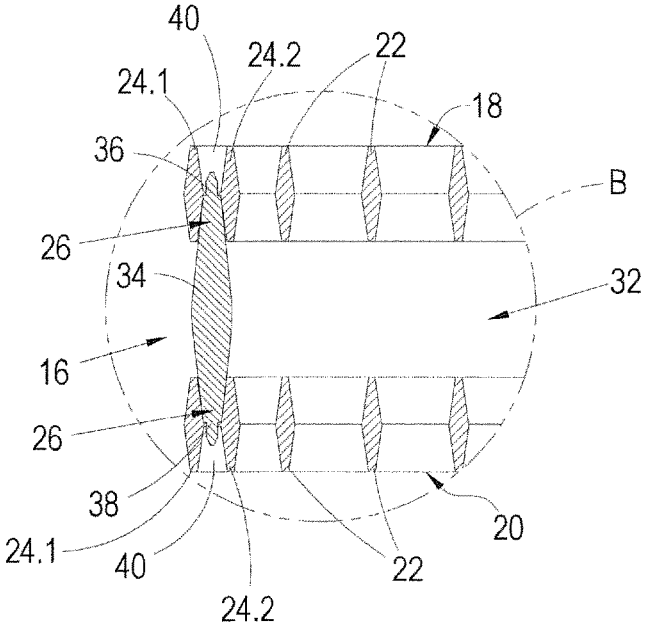
FIG. 5A shows enlarged detail B of FIG. 5, in accordance with an aspect of the present disclosure.
Figure 5B:
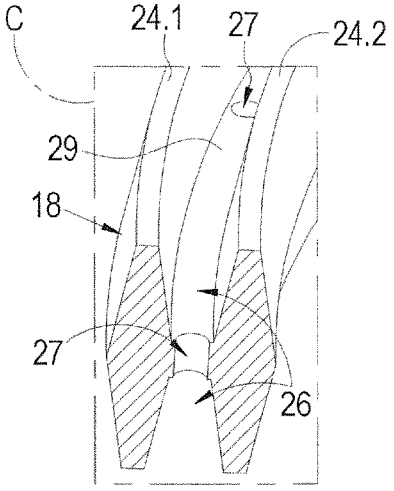
FIG. 5B shows a three-dimensional view of enlarged detail C of FIG. 5, in accordance with an aspect of the present disclosure.
Figure 6:
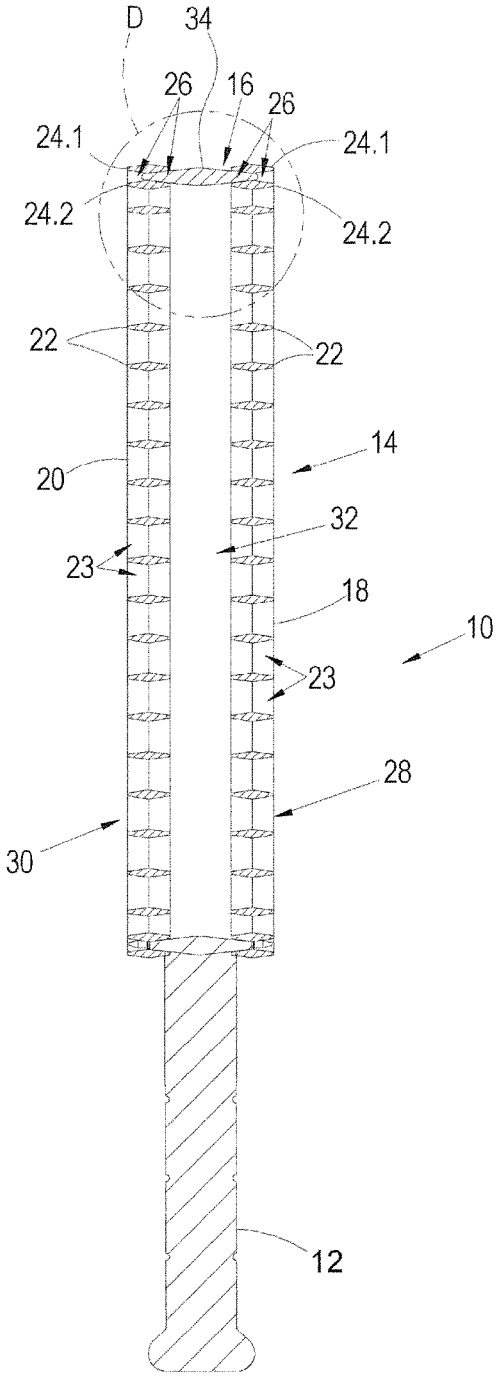
FIG. 6 shows a sectional side view of the bat of FIG. 1, sectioned along section line VI-VI of FIG. 1, in accordance with an aspect of the present disclosure.
Figure 6A:
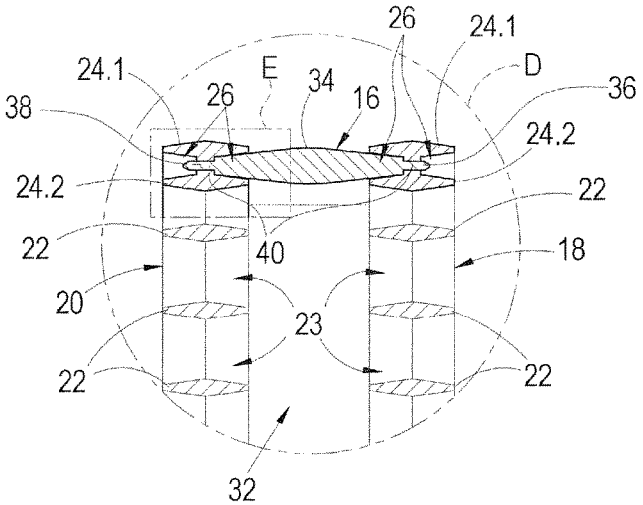
FIG. 6A shows enlarged detail D of FIG. 6, in accordance with an aspect of the present disclosure.
Figure 6B:
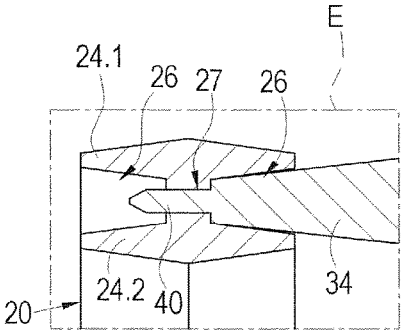
FIG. 6B shows enlarged detail E of FIG. 6A, in accordance with an aspect of the present disclosure.

With reference to FIGS. 1 to 6 of the drawings, a first embodiment of a bat for playing ball games, in accordance with the invention, is designated generally by the reference numeral 10. The bat is injection moulded of plastics material and is specifically adapted for playing ball games in playing areas smaller than traditional tennis courts. The bat 10 comprises, broadly, a handle 12 and a ball-striking head 14 for striking resilient balls.

The ball-striking head 14 has a symmetrical configuration comprising a peripheral support structure in the form of a rigid outer ring frame 16 which is injection moulded integrally with the handle 12, a first discrete single lattice structure 18 comprising a single lattice which is connected along an outer peripheral region of the lattice structure to a first side of the outer ring frame 16 and a second discrete lattice single structure 20 comprising a single planar lattice which is connected along an outer peripheral region of the lattice structure to an opposite second side of the outer ring frame 16.

The lattice structures 18, 20 are unstressed and of polypropylene, while the outer ring frame 16 is of acrylonitrile butadiene styrene (ABS) material.

The first lattice structure 18 is in the form of a semi-rigid single planar lattice element having an open perforated monolithic unitary construction, comprising a plurality of intersecting laths 22 which are arranged in an open grid pattern. The laths 22 extend longitudinally and laterally, intersecting one another at right angles, with openings 23 being defined between the laths. The lattice structure 18 includes a pair of spaced annular locating formations 24.1 and 24.2 which extend circumferentially around the laths 22 and which define back-to-back annular locating grooves 26 between them. Circumferentially spaced holes 27 are defined in a bridging base section 29 of the lattice structure defining the grooves, the purpose of which will be explained hereinbelow.

The second lattice structure 20 is identical to the first lattice structure 18 and is in the form of a semi-rigid single planar lattice element having an open perforated monolithic unitary construction, comprising a plurality of intersecting laths 22 which are arranged in an open grid pattern. The laths extend longitudinally and laterally, intersecting one another at right angles, with openings 23 being defined between the laths. The lattice structure 20 includes a pair of spaced annular locating formations 24.1 and 24.2 which extend circumferentially around the laths 22 and which define back-to-back annular locating grooves 26 between them. Circumferentially spaced holes 27 are defined in a bridging base section 29 of the lattice structure defining the grooves, the purpose of which will be explained hereinbelow.

The lattice structures 18 and 20 are securely connected to opposite sides of the outer ring frame 16 so as to define rigid unstressed ball-striking faces 28 and 30, respectively. In the assembled condition of the bat, the lattice structures 18 and 20 are spaced apart with opposing inner sides of the lattice structures 18, 20 defining an internal space 32 between them. The internal space is characterised by the absence of any internal load-bearing support structures. In this example, the internal space is hollow and unobstructed.

The outer ring frame 16 comprises a rigid annular wall 34 having a first outer edge 36 which is received within the groove 26 of the lattice structure 18 and a second outer edge 38 which is received within the groove 26 of the lattice structure 20 for locating the lattice structures 18 and 20 with respect to the outer frame 16. The outer edges 36, 38 of the wall 34 each define a plurality of spaced locating studs 40 projecting outwardly from the peripheral edges 36, 38. Each of the studs is located in one of the locating holes 27. The studs 40 provide weld pegs for ultrasonic spot welding 42 of the lattice structures 18, 20 to the outer frame 16. As such, the studs are melted and fused to the lattice structures in an ultrasonic welding process. In order to enhance the connection of the lattice structures to the outer frame, the lattice structures may be additionally bonded to the outer frame using a suitable adhesive.

Figure 7:
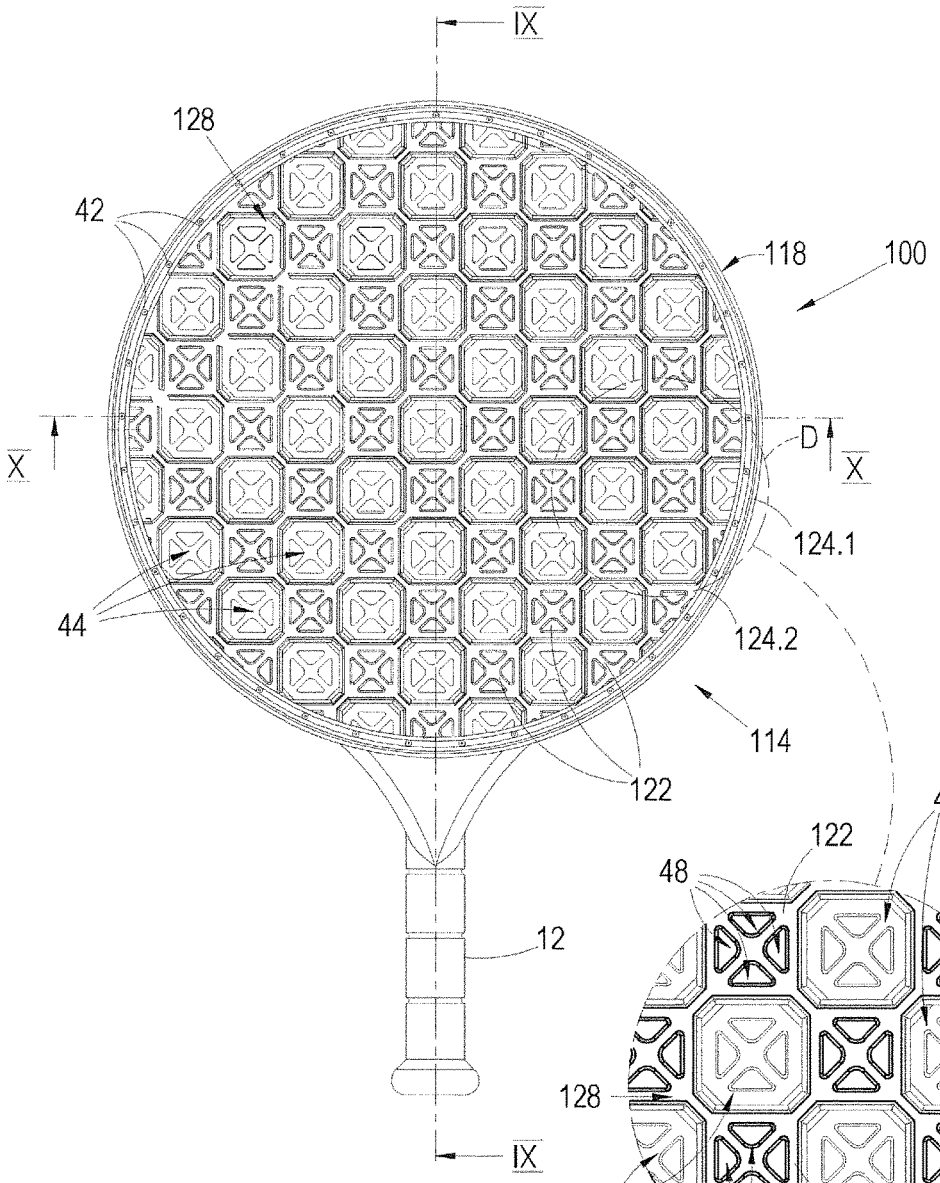
FIG. 7 shows a plan view of a second embodiment of a bat for playing ball games, in accordance with the invention.
Figure 7A:
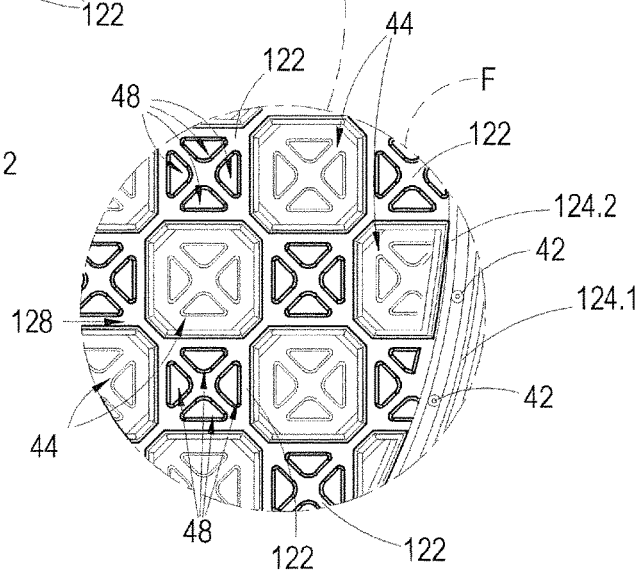
FIG. 7A shows enlarged detail F of FIG. 7, in accordance with an aspect of the present disclosure.
Figure 8:
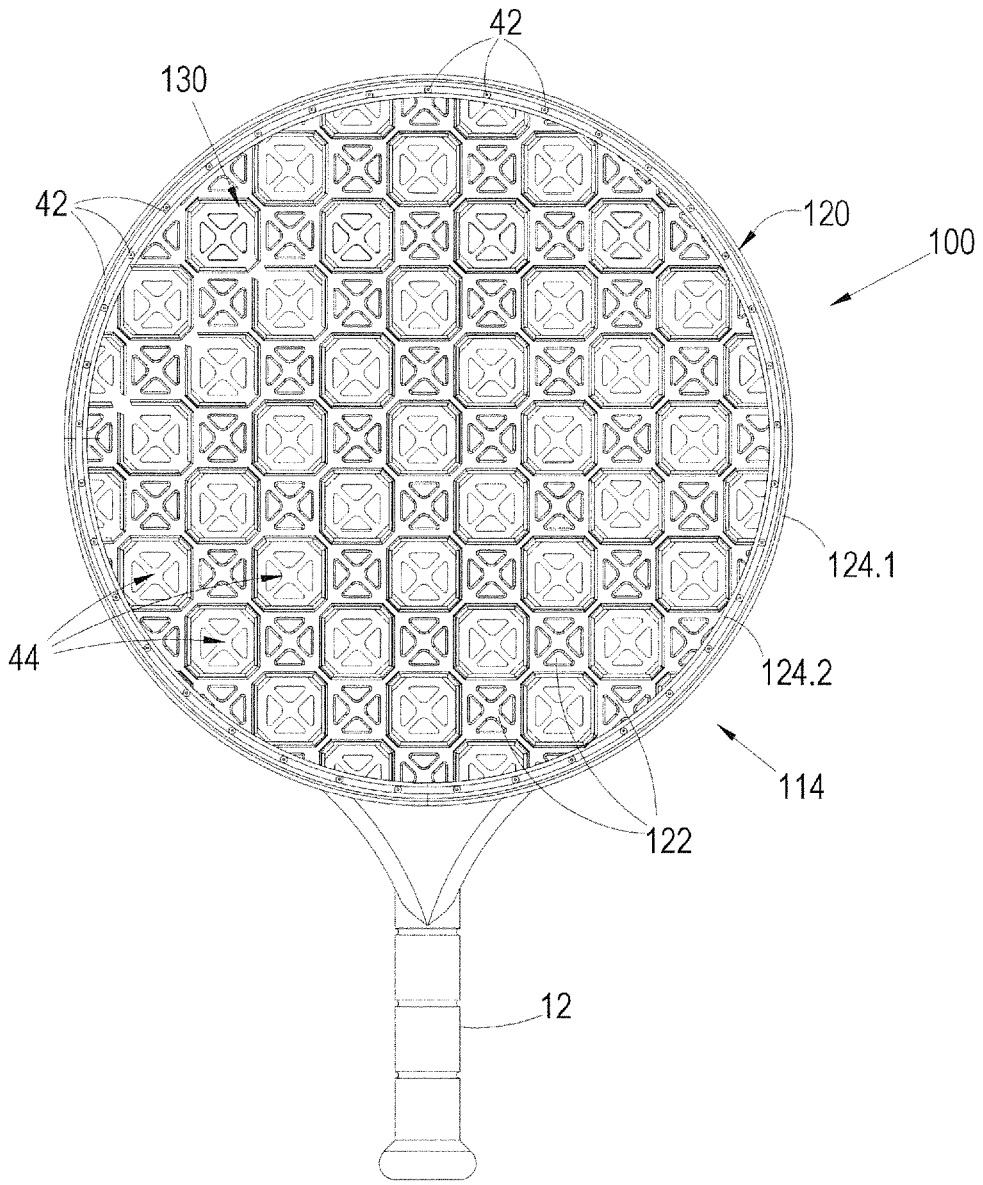
FIG. 8 shows an opposite plan view of the bat of FIG. 7, in accordance with an aspect of the present disclosure.
Figure 9:
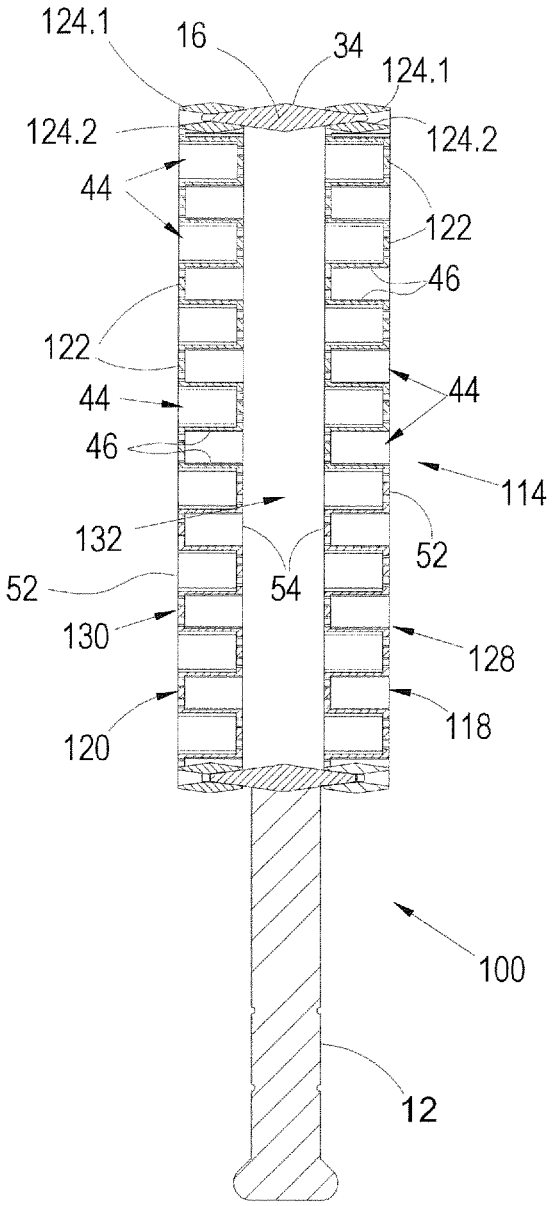
FIG. 9 shows a sectional side view of the bat of FIG. 7, sectioned along section line IX-IX of FIG. 7, in accordance with an aspect of the present disclosure.
Figure 10A:
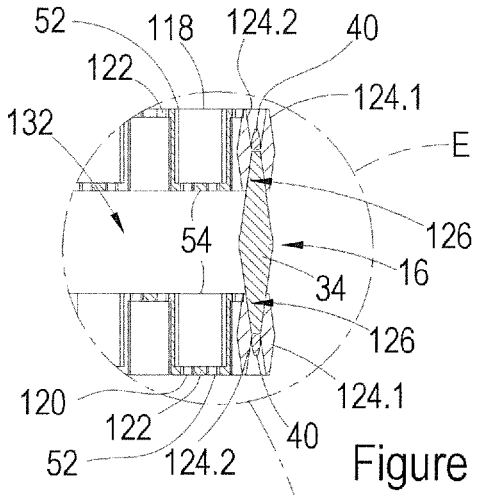
FIG. 10A shows enlarged detail G of FIG. 10, in accordance with an aspect of the present disclosure in accordance with an aspect of the present disclosure.
Figure 10:
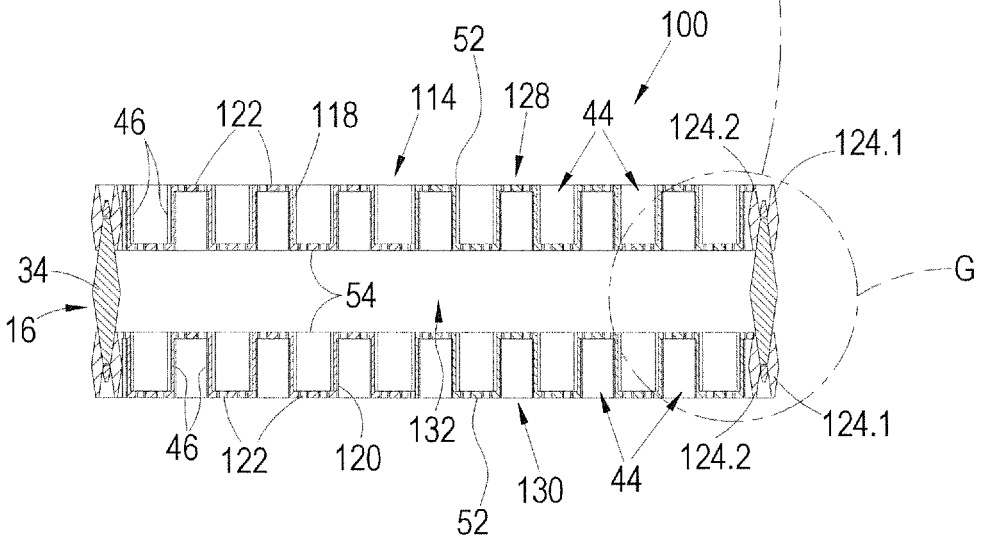
FIG. 10 shows a sectional end view of the bat of FIG. 7, sectioned along section line X-X of FIG. 7, in accordance with an aspect of the present disclosure.

With reference to FIGS. 7 to 10 of the drawings, there is provided a second embodiment of the bat in accordance with the invention, designated generally by the reference numeral 100. The bat 100 is similar to the bat 10 with a difference being that the single lattice structures 18 and 20 are replaced by double lattice structures. In FIGS. 7 to 10 of the drawings, those features of the bat 100 that are the same as and/or similar to those of the bat 10, are designated by the same and/or similar reference numerals. As such, the bat 100 comprises, broadly, a ball-striking head 114 having a symmetrical configuration comprising a peripheral support structure in the form of an outer ring frame 16 which is integrally moulded with a handle 12, a discrete first double lattice structure 118 and a discrete second double lattice structure 120 which are rigidly connected at outer peripheral regions thereof to opposite sides of the outer ring frame in the same manner in which the lattice structures 18 and 20 are connected to the outer ring frame 16 of the bat 10.

Each double lattice structure 118,120 has a plastics molded unitary monolithic construction and comprises a pair of spaced single planar inner and outer lattice elements 52, 54 supported by internal struts. A further difference between the bat 10 and the bat 100, is that the lattice elements 52, 54 each comprise a connected network of alternating webs 122 and unobstructed openings 44. As such, each lattice structure 118, 120 includes the inner lattice element 54 and the outer lattice element 52 and a plurality of internal struts 46 which are integrally moulded with the lattice elements so as to extend between the lattice elements. Outer sides of the outer lattice elements 52 of each double lattice structure 118, 120 define rigid ball-striking faces 128, 130, respectively. The webs 122 each define four triangular apertures 48 providing escape paths for air which is compressed between a ball and the outer lattice elements when the ball is struck by the bat, for noise attenuation purposes.

The double lattice structures 118, 120 each include a pair of spaced annular locating formations 124.1 and 124.2 which extend circumferentially around the network of webs and openings and which define back-to-back annular grooves 126 between them. Outer edges 36, 38 of the wall 34 of the outer frame are received in the inner grooves with the studs 40 being received within the holes 27 defined in the bridging base sections 29 of the lattice structures and secured via an ultrasonic welding process in the same manner as for the lattice structures 18, 20 of the bat 10.

As for the bat 10, the double lattice structures 118, 120 of the bat 100 are spaced apart so as to define a hollow unobstructed internal space 132 between them.

The ball-striking heads 14, 114 of the bats 10, 100, respectively, have a monocoque construction wherein the lattice structures together with the outer ring frames thereof, form a continuous outer skin surrounding the hollow internal space 32,132. The ball-striking heads 14,114 thus form a true monocoque system wherein the internal space defined between the lattice structures is characterised by the absence of any load-carrying support structures. As such, the outer skin comprising the lattice structures and the outer frame carries the compressive forces and loads applied to the ball-striking head when a ball is struck by the ball-striking surfaces of the lattice structures. The monocoque construction of the ball-striking head imparts stiffness and strength to the ball-striking head, allowing the ball-striking head to have a desirable lightweight construction which in turn allows the construction of a relatively thick ball-striking head which enhances overall rigidity of the ball-striking head.

In addition, the monocoque construction of the ball-striking head serves to absorb vibration forces imparted to the bat when a ball is struck by the bat by transmitting the vibration forces throughout the outer skin of the ball-striking head. In vibration tests conducted on the bats in accordance with the invention, by the Applicant, it was established that the monocoque design of the ball-striking head significantly reduces vibration transmitted via the ball-striking head to the handle. In the vibration acceleration tests conducted by PACE-WOOD BENCHMARK—Acoustic engineers for the Applicant, impact vibration transmitted to the handle of the bat, expressed in vibration acceleration in metres/second$^2$ (m/s$^2$), was measured at levels below 40 m/s$^2$ which provides the bats with a comfortable impact feel comparable to good quality strung tennis racquets.

The bats 10, 100 are designed for use with resilient balls having a bounce of at least 90 cm when subjected to a drop test wherein such balls are dropped from a height of 100 inches (254 cm) onto a rigid, hard horizontal, solid and flat impact surface. More specifically, the bats are designed for use with resilient balls having a diameter of between 40 mm and 90 mm and a weight of between 7.5 g and 75 g. The invention extends to a bat and ball kit including one or both of the bats 10,100 and a resilient ball as described hereinabove.

The relatively thick heads of the bats 10, 100 provide the bats with a sufficiently rigid construction to mitigate vibration upon impact with balls thereby providing the bats with a desirable impact feel. Furthermore, the apertures 48 in the webs 122 of the double lattice structures of the bats 100 provides for moderation of sound levels upon impact with a ball, such that decibel sound levels and the pitch thereof resulting from impact with balls, is moderated or modulated to acceptable levels.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The disclosure has been described with reference to the preferred embodiments. It will be understood that the architectural and operational embodiments described herein are exemplary of a plurality of possible arrangements to provide the same general features, characteristics, and general system operation. Modifications and alterations will occur to others upon a reading and understanding of the preceding detailed description. It is intended that the disclosure be construed as including all such modifications and alterations.

As may be recognized by those of ordinary skill in the art based on the teachings herein, numerous changes and modifications may be made to the above-described and other embodiments of the present disclosure without departing from the scope of the disclosure. The components of the invention as disclosed in the specification, including the accompanying abstract and drawings, may be replaced by alternative component(s) or feature(s), such as those disclosed in another embodiment, which serve the same, equivalent or similar purpose as known by those skilled in the art to achieve the same, equivalent or similar results by such alternative component(s) or feature(s) to provide a similar function for the intended purpose. In addition, the invention may include more or fewer components or features than the embodiments as described and illustrated herein. Accordingly, this detailed description of the currently-preferred embodiments is to be taken in an illustrative, as opposed to limiting of the disclosure.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Various numerical ranges are disclosed herein. These ranges are inclusive of the endpoints as well as numerical values between these endpoints. The numbers in these ranges are interchangeable.

The corresponding structures, materials, acts, and equivalents of all means or step plus function elements in the claims below, if any, are intended to include any structure, material, or act for performing the function in combination with other claimed elements as specifically claimed. The description of one or more embodiments has been presented for purposes of illustration and description, but is not intended to be exhaustive or limited to in the form disclosed. Many modifications and variations will be apparent to those of ordinary skill in the art. The embodiment was chosen and described in order to best explain various aspects and the practical application, and to enable others of ordinary skill in the art to understand various embodiments with various modifications as are suited to the particular use contemplated.

The invention claimed is:

1. A plastics bat including a handle and a ball-striking head for striking resilient balls, wherein the ball-striking head has a monocoque construction and further comprises:

a first discrete unstressed plastic lattice structure defining a first ball-striking surface of the bat;

a second discrete unstressed plastic lattice structure defining a second ball-striking surface of the bat; and at least one peripheral support structure, wherein the lattice structures are connected to opposite sides of the peripheral support structure at outer peripheral regions of the lattice structures in a spaced apart arrangement, wherein an internal space is defined between the first and second lattice structures absent of any load-bearing internal support structures, and wherein each of the first and second lattice structures are in the form of a double lattice comprising a pair of spaced planar lattice elements supported by internal struts.

2. The plastics bat of claim 1, wherein each of the first and second lattice structures has a unitary monolithic structure.

3. The plastics bat of claim 1, wherein each of the first and second lattice structures comprises a number of spaced intersecting laths arranged in an open grid pattern wherein openings are defined between the intersecting laths.

4. The plastics bat of claim 1, wherein each of the first and second lattice structures comprises a distributed network of alternating webs and unobstructed openings.

5. The plastics bat of claim 1, wherein the peripheral support structure of the ball-striking head of the bat comprises an outer ring frame to which the lattice structures are connected.

6. The plastics bat of claim 5, wherein the lattice structures are fixedly connected to the outer ring frame along peripheral edge regions of the lattice structures.

7. The plastics bat of claim 5, wherein the lattice structures and the outer frame form a continuous load-carrying outer skin surrounding the unobstructed internal space.

8. A bat and ball kit comprising the plastics bat of claim 1 and a resilient ball having a diameter of between 40 mm and 90 mm and a weight of between 7.5 g and 75 g.

* * * * *